US005535525A

United States Patent [19]

Gardner

[11] Patent Number: 5,535,525

[45] Date of Patent: Jul. 16, 1996

[54] VAPOR/LIQUID PHASE SEPARATOR FOR AN OPEN TANK IPA-DRYER

[75] Inventor: Keith R. Gardner, San Antonio, Tex.

[73] Assignee: VLSI Technology, Inc., San Jose, Calif.

[21] Appl. No.: 214,481

[22] Filed: Mar. 17, 1994

[51] Int. Cl.[6] ..... F26B 21/06

[52] U.S. Cl. ..... 34/78; 134/105; 134/109; 34/74; 34/102

[58] Field of Search ..... 34/467, 468, 469, 34/72, 73, 76–78; 210/774; 134/105, 108, 902

[56] References Cited

U.S. PATENT DOCUMENTS

| | | | |
|---|---|---|---|
| 2,095,219 | 10/1937 | Lear | 62/290 |
| 3,931,683 | 1/1976 | Crites et al. | 34/73 |
| 4,132,567 | 1/1979 | Blackwood | 134/902 |
| 4,766,737 | 8/1988 | Baxter, II | 62/291 |
| 5,054,210 | 10/1991 | Schumacher et al. | 34/78 |
| 5,371,950 | 12/1994 | Schumacher | 34/78 |

FOREIGN PATENT DOCUMENTS

| | | | |
|---|---|---|---|
| 3122571 | 9/1983 | Germany | 34/73 |
| 360124 | 3/1991 | Japan | 134/902 |

*Primary Examiner*—John M. Sollecito
*Assistant Examiner*—Steve Gravini
*Attorney, Agent, or Firm*—Partick T. King

[57] ABSTRACT

An Isopropyl Alcohol (IPA) tank vapor/liquid phase separator for collecting liquid while still allowing for efficient vapor flow in an IPA tank includes a first row and a second row of spaced-apart coplanar parallel catch trays. Vapor flows upwardly through the openings between the catch trays. The catch trays are arranged so that contaminated IPA condensate falls into either the first or second row of catch trays. In one embodiment, both of the catch trays are upright V-shaped or upright semi-circular-shaped. In another embodiment the catch trays are formed as plates with staggered holes formed therein for upward passage of vapor and for downward collection of condensate.

15 Claims, 7 Drawing Sheets

VAPOR/LIQUID PHASE SEPARATOR FOR AN OPEN TANK IPA-DRYER

BACKGROUND OF THE INVENTION

1. Field of the Invention

The present claimed invention relates to the field of semiconductor wafer processes. More specifically, the present claimed invention relates to Isopropyl Alcohol (IPA) tanks used to clean semiconductor wafers.

2. Prior Art

During semiconductor wafer fabrication processes, the semiconductor wafers require periodic cleaning. One common method of cleaning uses an IPA tank. The IPA tank contains very pure liquid IPA in the bottom thereof. Cooling or condensation coils are located around the inner edge of the IPA tank above the level of the liquid IPA contained within the IPA tank. The liquid IPA in the bottom of the IPA tank is heated so that a vapor of IPA is produced. The vaporized IPA rises within the IPA tank until it reaches the level of the cooling coils. When the vaporized IPA reaches the level of the cooling coils it condenses back into liquid IPA, referred to as "condensate", and falls back into the reservoir of liquid IPA located in the bottom of the IPA tank.

During a typical cleaning operation, a group or "rack" of semiconductor wafers to be cleaned are lowered into the IPA tank. The rack of wafers are located at such a level within the tank such that the cooling coils peripherally surround the rack of wafers. Thus, the vaporized IPA condenses on the semiconductor wafers. The IPA removes contaminate particles and facilitates efficient removal of residual deionized water which may remain on the semiconductor wafers as a result of previous process steps. The contaminated condensate drips from the semiconductor wafers back towards the reservoir of very pure IPA. Commonly, a flat bottom catch tray is arranged within the IPA tank between the reservoir of very pure IPA and the semiconductor wafers. In so doing, drops of contaminated condensate which drip from the semiconductor wafers are caught by the flat bottom catch tray and do not contaminate the reservoir of very pure IPA in the bottom of the catch tank. The drops of contaminated IPA are removed via a drain in the flat bottom catch tray. Thus, the catch tray functions as a liquid/vapor IPA tank separator.

Unfortunately, conventional IPA tanks employing flat bottom catch trays have severe drawbacks. In instances where the flat bottom catch tray is in contact with the reservoir of very pure IPA, the top surface area of the reservoir of IPA, from which evaporation would take place, is dramatically reduced. Furthermore, by placing a flat bottom catch tray above the surface of the very pure IPA reservoir, the flow of vaporized IPA is significantly restricted. That is, upward flow of vaporized IPA occurs only from those portions of the IPA reservoir which are not covered by the flat bottom catch tray. Thus, upward flow of vaporized IPA occurs only from those portions of the IPA reservoir located between the outer edge of the flat bottom catch tray and the side of the IPA tank.

The upward flow of vaporized IPA is essential for effective cleaning of the semiconductor wafers. If the flow of vaporized IPA is not great enough, premature drying of the deionized water may occur resulting in the deposition of deleterious residue on the semiconductor wafers, or inadequate particle removal. Additionally, when the rack of semiconductor wafers, is placed into the IPA tank, vaporized IPA present within the tank may be displaced and forced out of the IPA tank. Thus, additional vaporized IPA must be produced to replace the displaced vaporized IPA. The time that is required to replace the lost vaporized IPA is referred to as the recovery time of the IPA tank. If the upward flow of the vaporized IPA is obstructed by a flat bottom catch tray, the recovery time of the tank is adversely affected thereby increasing the possibility of inadequate particle removal and/or premature drying of any deionized water.

In an attempt to deal with the problems associated with restricted flow of vaporized IPA, alternate types of catch trays or liquid/vapor IPA tank separators have been employed. Typically, these trays are formed of sloped plates placed above the top surface of the IPA reservoir. Although newer trays do not contact as much of the top surface area of the reservoir of IPA, these trays still greatly restrict the flow of vaporized IPA at the center of the IPA tank. As a result the flow of vaporized IPA is again forced to the outer edges of the IPA tank.

Thus, the need has arisen for a liquid/vapor IPA tank separator or "catch tray" which does not contact a large portion of the top surface area of the reservoir of IPA, which does not significantly restrict the upward flow of vaporized IPA, and which does not force the flow of vaporized IPA to the edges of the IPA tank.

SUMMARY OF THE INVENTION

It is therefore an object of the present invention to provide a liquid/vapor IPA tank separator or "catch tray" which does not contact a large portion of the top surface area of the reservoir of IPA, which does not significantly restrict the upward flow of vaporized IPA, and which does not force the flow of vaporized IPA to the edges of the IPA tank. The above object has been achieved with a liquid/vapor phase separator formed of two offset parallel catch trays having openings formed therethrough.

In one embodiment of the present claimed invention, a first row of coplanar parallel catch trays are placed above the top surface of very pure liquid IPA located in the bottom of an IPA tank. The catch trays are spaced apart from each other such that an opening large enough to accommodate the upward flow of vaporized IPA is located between adjacent catch trays. A second row of a coplanar parallel catch trays is located between the top surface of very pure liquid IPA and the first row of catch trays. As in the first row, the catch trays in the second row are spaced apart from each other such that an opening large enough to accommodate the upward flow of vaporized IPA is located between adjacent catch trays. The second row of catch trays is arranged beneath the first row of catch trays such that catch trays of the second row are located directly under the openings present between the catch trays in the first row and such that the openings between the catch trays of the second row are located directly under the catch trays of the first row. Both rows of catch trays are coupled to a drain in the IPA tank. In so doing, IPA vapor can flow without significant restriction from the bottom of the IPA tank upwardly through the openings between the catch trays of the second row, and can then flow upwardly through the openings between the catch trays of the first row without being forced to the outer edges of the IPA tank. However, any contaminated IPA condensate falling from the top of the IPA tank will be collected in a catch tray of the first row, or fall through an opening between two adjacent catch trays in the first row and then be collected in a catch tray of the second row. As a result, no contaminated IPA condensate will pass through the two rows of catch trays and contact the reservoir of IPA located in the bottom of the IPA tank. Thus, the present embodiment of the invention provides for efficient upward IPA vapor flow while simultaneously collecting all contaminated IPA condensate.

In another embodiment of the present invention, a first plate is placed above the top surface of very pure liquid IPA located in the bottom of an IPA tank. The plate has openings formed therethrough which are large enough to accommodate the upward flow of vaporized IPA. A second plate is located between the top surface of very pure liquid IPA and the first plate. As in the first plate, the second plate has openings formed therethrough which are large enough to accommodate the upward flow of vaporized IPA. Both plates have raised areas on the top surface thereof which peripherally surround the openings. As a result, any contaminated condensate which is collected on the top surface of either of the plates will not run into the openings on that plate. The second plate is arranged beneath the first plate such that the openings present on the second plate do not reside directly under the openings of the first plate. Both plates are coupled to a drain in the IPA tank. In so doing, IPA vapor can flow without significant restriction from the bottom of the IPA tank upwardly through the openings in the second plate, and can then flow upwardly through the openings in the first plate without being forced to the outer edges of the IPA tank. However, any contaminated IPA condensate falling from the top of the IPA tank will be collected on the first plate, or fall through an opening on the first plate and then be collected on the second plate. As a result, no contaminated IPA condensate will pass through the two plates and contact the bottom surface of the IPA tank. Thus, the present embodiment of the invention provides for efficient upward IPA vapor flow while simultaneously collecting all contaminated IPA condensate.

BRIEF DESCRIPTION OF THE DRAWINGS

The accompanying drawings, which are incorporated in and form a part of this specification, illustrate embodiments of the invention and, together with the description, serve to explain the principles of the invention:

FIG. 6 is a partial cross-sectional view taken along section line 6—6 of FIG. 5.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
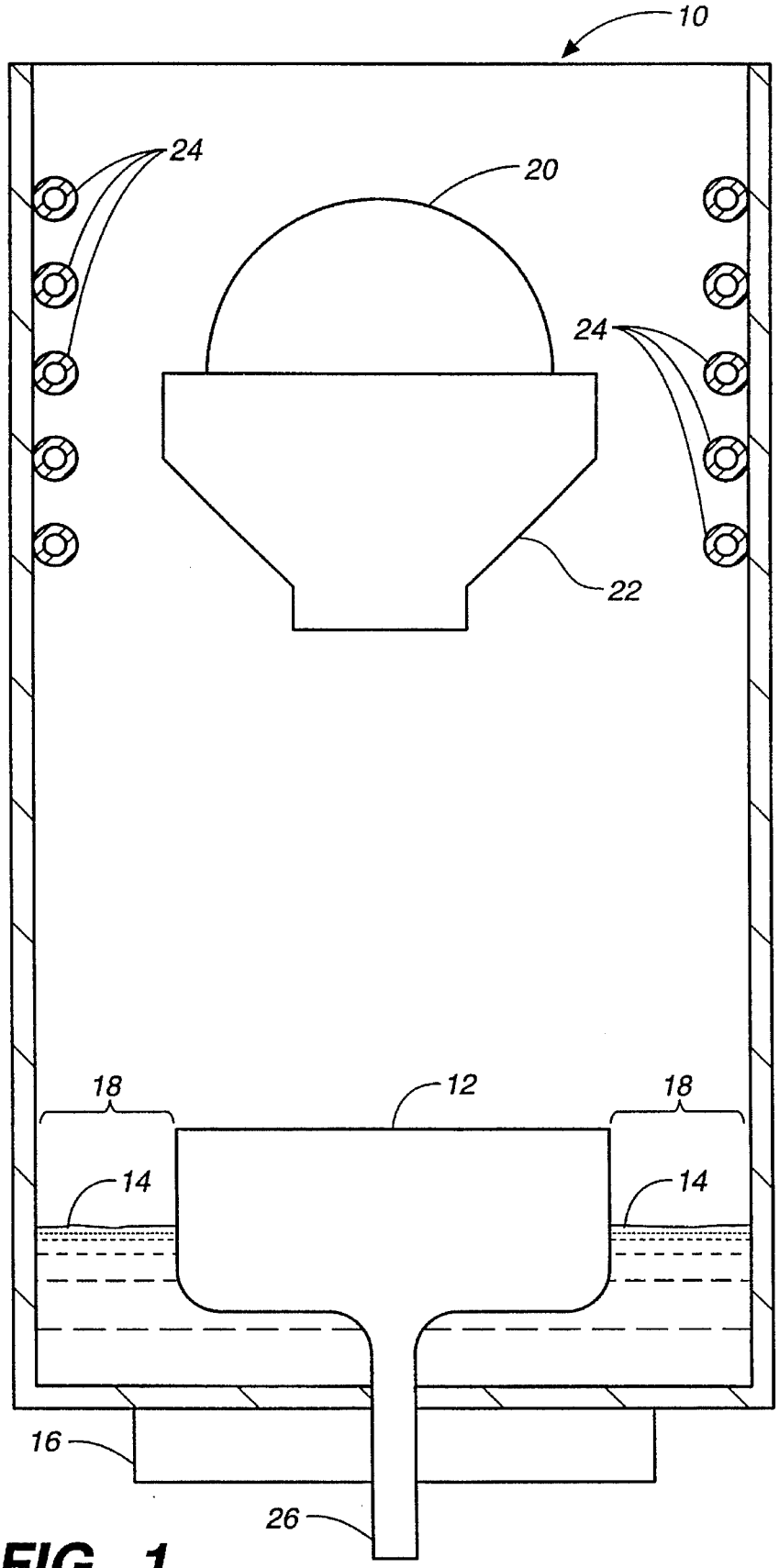
FIG. 1 PRIOR ART
FIG. 1 is a section view of a Prior Art IPA tank containing a flat bottom catch tray.

With reference now to Prior Art FIG. 1, a side section view of a conventional IPA tank 10 containing a flat bottom catch tray 12 is shown. IPA tank 10 contains a reservoir of IPA 14 in the bottom thereof. A hot plate 16 heats the bottom surface of IPA tank 10 such that IPA 14 contained therein is heated to its boiling point thereby producing IPA vapor within IPA tank 10. In so doing, an upward flow of IPA vapor is generated within tank 10. The vaporized IPA rises towards the rack of semiconductor wafers, typically shown as 20, contained within a holder 22. Semiconductor wafers 20 and holder 22 are peripherally surrounded by cooling or condensation coils 24 disposed along the inner edge of IPA tank 10. When the IPA vapor rises to the level of cooling coils 24, the IPA vapor condenses onto semiconductor wafers 20 and removes contaminate particles from semiconductor wafers 20. The contaminated IPA condensate then drips off of semiconductor wafers 20 and falls into flat bottom catch tray 12. The contaminated condensate is removed from flat bottom catch tray 12 via a drain 26.

With reference still to Prior Art FIG. 1, because flat bottom catch tray 12 covers a large portion of IPA 14 in tank 10, the upward flow of vaporized IPA occurs only from those portions 18 of the IPA reservoir 14 which are not covered by flat bottom catch tray 12. That is, in the configuration of Prior Art FIG. 1, upward flow of vaporized IPA occurs only from portions 18 of IPA reservoir 14 located between the outer edge of flat bottom catch tray 12 and the side of IPA tank 10. Furthermore, the upward flow of IPA vapor occurs primarily at the edges of IPA tank 10, instead of directly under semiconductor wafers 20 as desired. As a result, the efficiency of IPA tank 10 is severely diminished. Additionally, IPA tank 10 suffers from an extended recovery time when attempting to replace any lost IPA vapor.

Figure 2:
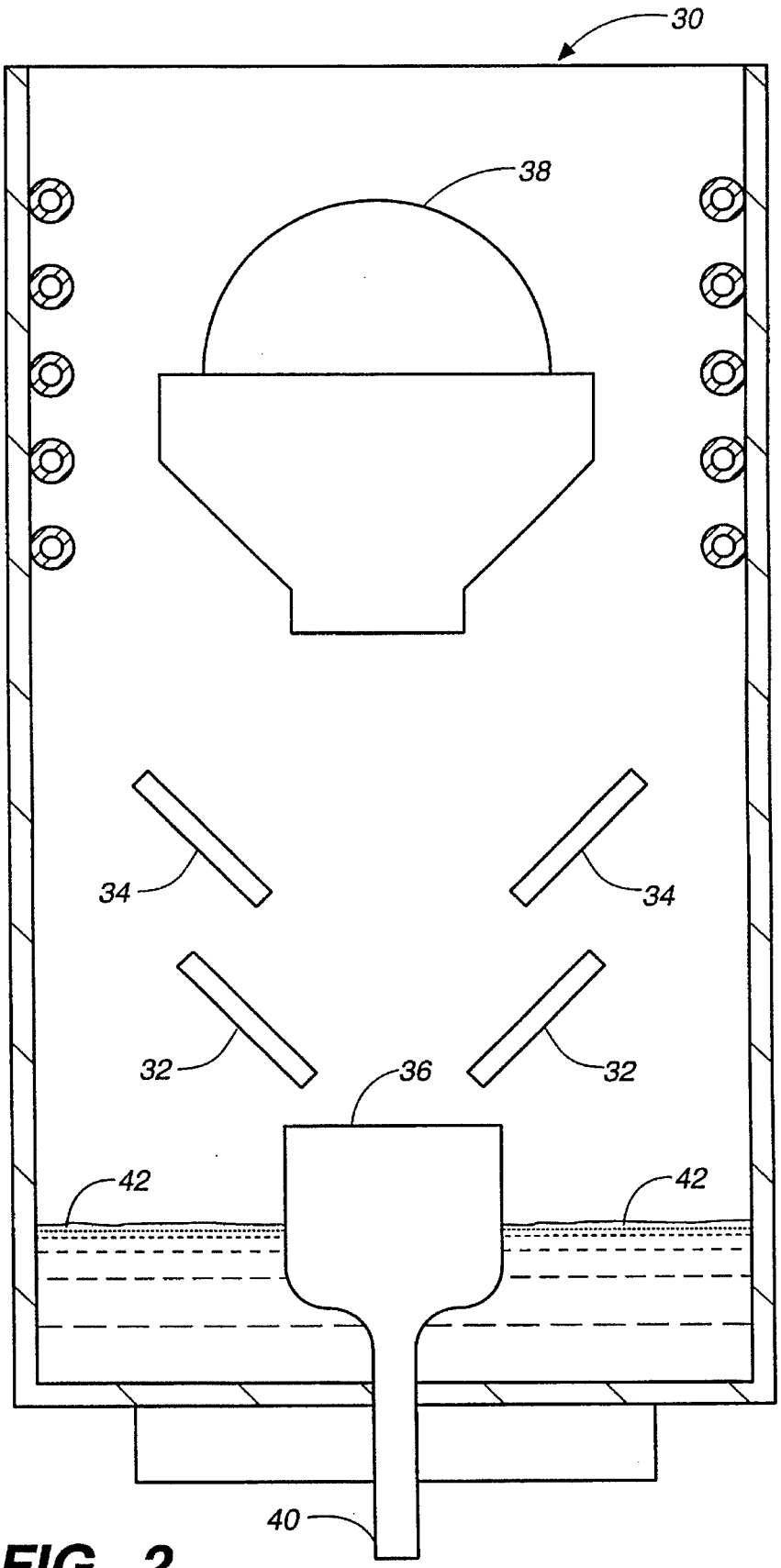
FIG. 2 PRIOR ART
FIG. 2 is a section view of another Prior Art IPA tank containing a parallel vane catch tray.

With reference now to Prior Art FIG. 2, a side section view of another conventional IPA tank 30 containing a parallel vane catch tray is shown. The parallel vane catch tray of Prior Art FIG. 2, is comprised of two parallel vanes 32 and 34 and a catch tray 36. Contaminated condensate which drips from semiconductor wafers, typically shown as 38, contacts vanes 32 and 34 and is channeled into catch tray 36. The contaminated condensate is removed from catch tray 36 via a drain 40.

With reference still to Prior Art FIG. 2, the surface area of IPA 42 covered by catch tray 36 is smaller than the surface area covered by flat bottom catch tray 12 of Prior Art FIG. 1. As a result, a greater flow of vaporized IPA can be achieved by the embodiment of Prior Art FIG. 2. However, the upward flow of vaporized IPA occurs only from those portions of IPA reservoir 42 located between the outer edge of catch tray 36 and the side of IPA tank 30. Additionally, in an attempt to provide for upward flow of vaporized IPA at the center of IPA tank 30 directly under semiconductor wafers 38, parallel vanes 32 and 34 are slightly separated from each other. In so doing, a portion of the vaporized IPA produced directly under the parallel vanes 32 and 34 is able to flow upwardly through the space present between vanes 32 and 34. However, in the embodiment of Prior Art FIG. 2, the upward flow of vapor is still forced to the outer edges of tank 30. Furthermore, in the Prior Art configuration of FIG. 2, uncontaminated IPA vapor will condense onto the underside of parallel vanes 32 and 34. This uncontaminated condensate is flows along the bottom edges of parallel vanes 32 and 34 and is deposited into catch tray 36. Thus, clean uncontaminated IPA condensate is wasted by the device of Prior Art FIG. 2.

Figure 3:
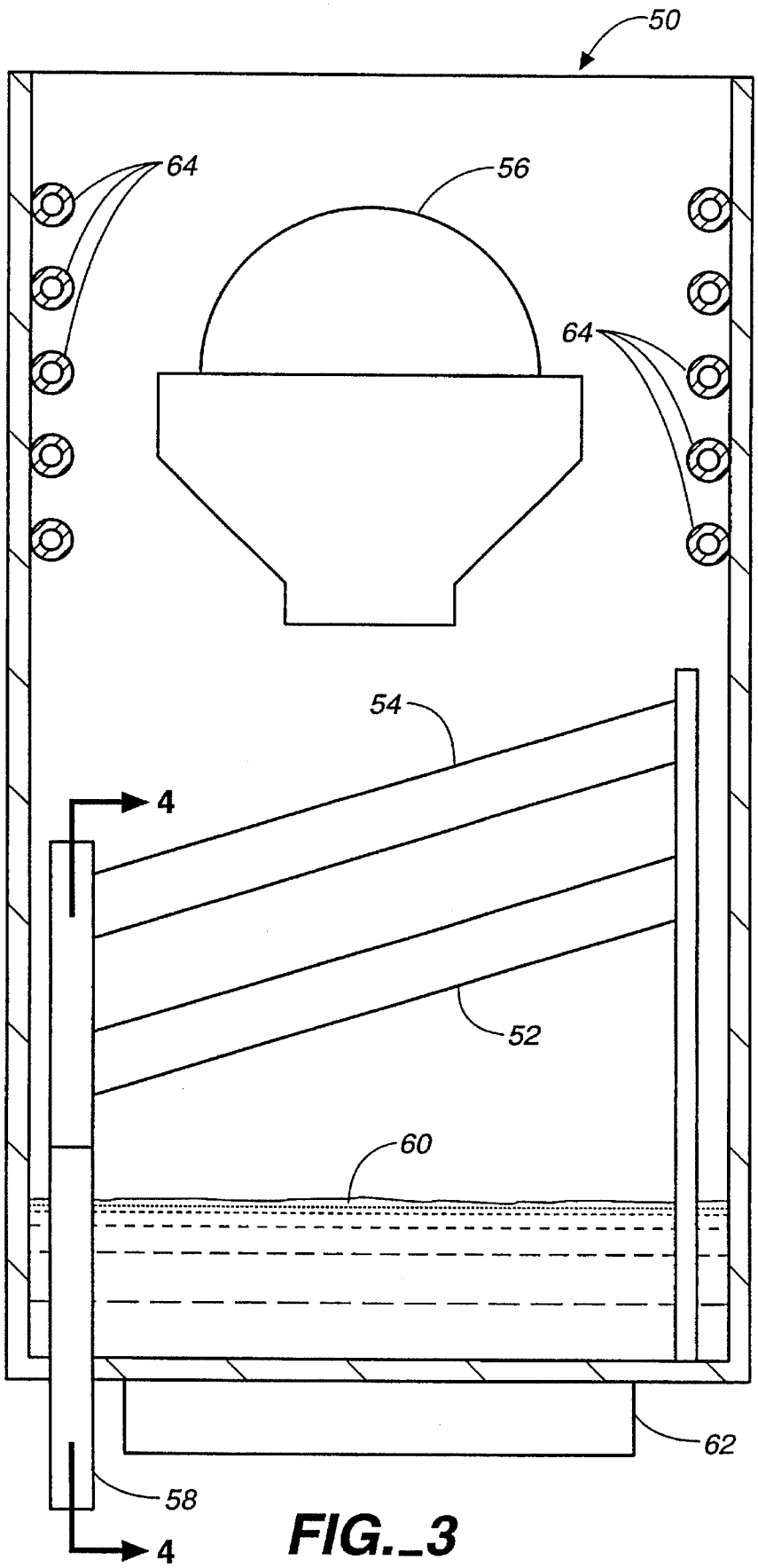
FIG. 3 is a section view of an IPA tank with two offset rows each containing a plurality of coplanar parallel catch trays in accordance with the present claimed invention.

Referring now to FIG. 3, a cut-away side view of an IPA tank 50 with two offset rows 52 and 54 each containing a plurality of coplanar parallel catch trays is shown. As shown in FIG. 3, rows 52 and 54 are tilted so that any contaminated condensate dripping from semiconductor wafers, typically shown as 56, and collected onto rows 52 or 54 will flow to a drain 58. IPA tank 50 contains a reservoir 60 of very pure IPA in the bottom thereof. In the present invention, when hot plate 62 heats IPA to its boiling point, in the range of approximately 82.4 degrees Celsius at one atmosphere, IPA vapor is able to rise upwardly through rows 52 and 54 without being forced to flow primarily along the outer edges of tank 50. Thus, a greater flow of IPA vapor is achieved at the center of IPA tank 50 directly under semiconductor wafers 56. Therefore, an abundant flow of vaporized IPA rises in the center of IPA tank 50, until it reaches the level of the cooling coils 64. Cooling coils 64 cool the adjacent area of IPA tank to about 25 degrees Celsius so that condensation of the vaporized IPA occurs. Thus, the present embodiment of the invention provides for increased condensation of the vaporized IPA onto semiconductor wafers 56. As a result, the effectiveness of IPA tank 50 for cleaning semiconductor wafers 56 is substantially increased. That is, the present embodiment of the invention more efficiently removes contaminate particles and facilitates efficient removal of residual deionized water which may remain on semiconductor wafers 56 as a result of previous process steps.

With reference again to FIG. 3, in the present embodiment of the claimed invention, unlike the prior art, no portion of the top surface of IPA reservoir 60 is in contact with a catch tray such as catch tray 12 of Prior Art FIG. 1, or catch tray 36 of Prior Art FIG. 2. Thus, the present embodiment of the claimed invention does not restrict or limit the surface area from which vaporized IPA may be generated. As a result, the present embodiment of the claimed invention achieves greater cleaning efficiency, provides for uniform generation of vaporized IPA vapor across the top surface of IPA reservoir 60, and does not force the majority of IPA vapor to the outer edges of tank 50.

Figure 4A:
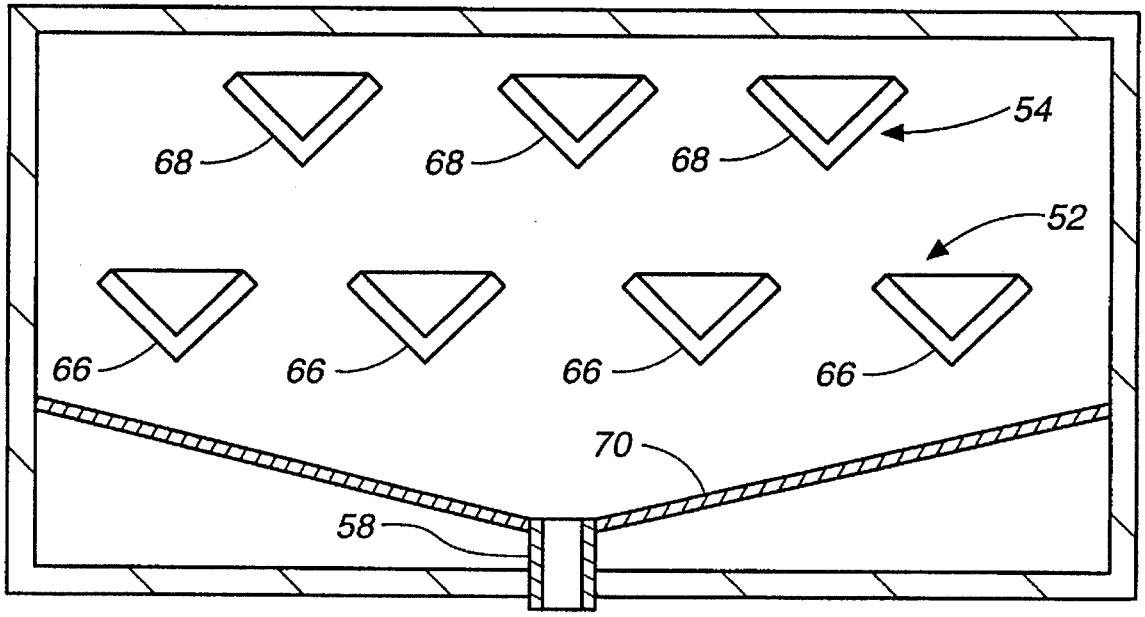
FIG. 4A is a section view, taken along section line 4—4 of V-shaped embodiments of FIG. 3, of the two offset rows of FIG. 3.

With reference now to FIG. 4A, a section view of rows 52 and 54 of FIG. 3 taken along line 4—4 of FIG. 3 is shown. As shown in FIG. 4A, rows 52 and 54 are comprised of a plurality of coplanar parallel V-shaped catch trays 66 and 68, respectively. Each parallel coplanar V-shaped catch tray 68 of row 54 is separated from adjacent V-shaped catch trays 68 so that an opening exists between each adjacent parallel coplanar V-shaped catch tray. Likewise, each parallel coplanar V-shaped catch tray 66 of row 52 is separated from adjacent V-shaped catch trays 66 so that an opening exists between each adjacent parallel coplanar V-shaped catch tray. In so doing, vaporized IPA is able to rise from the bottom of tank 50 of FIG. 3, proceed through the openings present between adjacent parallel coplanar V-shaped catch trays 66, and then continue upward and proceed through the openings present between adjacent parallel coplanar V-shaped catch trays 68. Thus, in the present embodiment of the claimed invention, vaporized IPA is able to flow upwardly from the center of tank 50 of FIG. 3 without being forced to the outer edges of tank 50.

With reference still to FIG. 4A, offset rows 52 and 54 prevent contaminated condensate from dripping off of the semiconductor wafers and back into the reservoir of very pure IPA. Specifically, any contaminated condensate which falls from semiconductor wafers 56 of FIG. 3 will either be collected on V-shaped catch trays 68, or fall through the openings between V-shaped catch trays 68. However, by arranging rows 52 and 54 in an offset manner as set forth in the present embodiment, any condensate which falls through the openings between V-shaped catch trays 68 will be collected by V-shaped catch trays 66 of row 52. In the present embodiment, V-shaped catch trays 66 and 68 are positioned in a tilted configuration so that any contaminated condensate collected in V-shaped catch trays 66 or 68 will flow towards the collector tray 70 and be funneled into drain 58. Thus, the present invention does not significantly restrict the upward flow of vaporized IPA, and does not force the flow of vaporized IPA to the edges of IPA tank 50 of FIG. 3.

With reference again to FIG. 4A, by forming catch trays 66 and 68 as V-shaped trays, any uncontaminated IPA vapor which condenses onto the bottom surface of catch trays 68 will flow down the bottom surface of catch trays 68 and drip off of the lowest point of catch trays 68. However, by arranging rows 52 and 54 in an offset manner as set forth in the present embodiment, any uncontaminated condensate which falls off of the lowest point of V-shaped catch trays 68 will pass through the openings between V-shaped catch trays 66 and will fall back into IPA reservoir 60 of FIG. 3. Likewise, any uncontaminated IPA vapor which condenses onto the bottom surface of V-shaped catch trays 66 will flow down the bottom surface of V-shaped catch trays 66 and will fall back into IPA reservoir 60 of FIG. 3. Thus, the present embodiment, unlike the prior art, returns uncontaminated condensate to the IPA reservoir so that it may be utilized. As a result, the present embodiment of the claimed invention reduces IPA waste.

With reference still to FIG. 4A, several substantial benefits are realized by the present claimed invention. By allowing almost the entire surface of IPA reservoir 60 of FIG. 3 to remain uncovered, an increased vapor recovery time is achieved. Specifically, the present claimed invention achieves recovery times in the range of 10 seconds as opposed to 40 second recovery times found in the prior art. Thus, when a rack of semiconductor wafers is inserted into tank 50 of FIG. 3, any lost IPA vapor can be quickly replaced. Therefore, the present claimed invention reduces the possibility of premature drying of any deionized water present on the semiconductor wafers. In eliminating the possibility of residue deposition by preventing premature drying of any deionized water, the reliability and yield of the semiconductor wafers is improved. Also, by providing for greater production of IPA vapor, the amount of time required to properly clean a rack of semiconductor wafers is reduced. In so doing, the required process time is shortened thereby increasing throughput and productivity of the IPA cleaning system.

Referring still to FIG. 4A, in the present embodiment of the claimed invention, rows 52 and 54 and supporting structures located at the ends of rows 52 and 54 are formed, for example, of quartzware or stainless steel. Although such materials are used in the present embodiment, the present claimed invention is well suited to numerous other types of material well known in the art. Additionally, although drain 58 is located at one end of rows 52 and 54 in the present embodiment, the claimed invention is also well suited to other configurations of rows 52 and 54 which would allow drain 58 to be located elsewhere in tank 50, including but not limited to, for example, the center of tank 50. Furthermore, although catch trays 66 and 68 are V-shaped in the present embodiment, the claimed invention is also well suited to numerous variations in the shape of catch trays 66 and 68.

Figure 4B:
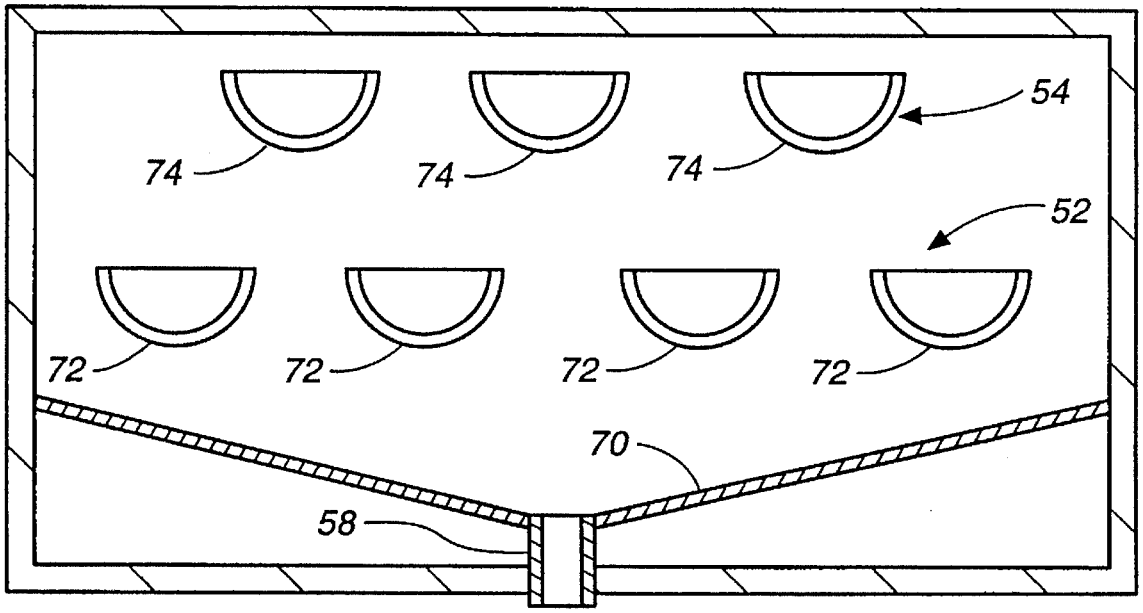
FIG. 4B is a section view of another embodiment of the two offset rows of FIG. 3 taken along section line 4—4 of FIG. 3.

With reference next to FIG. 4B, a section view of another embodiment of rows 52 and 54 of FIG. 3 taken along line 4—4 of FIG. 3 is shown. As shown in FIG. 4B, the catch trays 72 and 74 of rows 52 and 54 are semi-circular in shape. Each parallel coplanar semi-circular catch tray 74 of row 54 is separated from adjacent semi-circular catch trays 74 so that an opening exists between each adjacent parallel coplanar semi-circular catch tray. Likewise, each parallel coplanar semi-circular catch tray 72 of row 52 is separated from adjacent semi-circular catch trays 72 so that an opening exists between each adjacent parallel coplanar semi-circular catch tray. In so doing, vaporized IPA is able to rise from the bottom of tank 50 of FIG. 3, proceed through the openings present between adjacent parallel coplanar semi-circular catch trays 72, and then continue upward and proceed through the openings present between adjacent parallel coplanar semi-circular catch trays 74. Thus, in the present embodiment of the claimed invention, vaporized IPA is able to flow upwardly from the center of tank 50 of FIG. 3 without being forced to the outer edges of the tank.

With reference again to FIG. 4B, by forming catch trays 72 and 74 as semi-circular trays, any uncontaminated IPA vapor which condenses onto the bottom surface of catch trays 74 will flow down the bottom surface of catch tray 74 and drip off of the lowest point of catch trays 74. However, by arranging rows 52 and 54 in an offset manner as set forth in the present embodiment, any uncontaminated condensate which falls off of the lowest point of semi-circular catch trays 74 will pass through the openings between semi-circular catch trays 72 and will fall back into IPA reservoir 60 of FIG. 3. Likewise, any uncontaminated IPA vapor which condenses onto the bottom surface of semi-circular catch trays 72 will flow down the bottom surface of semi-circular catch trays 72 and will fall back into IPA reservoir 60 of FIG. 3. Thus, the present embodiment, unlike the prior art, returns uncontaminated condensate to the IPA reservoir so that it may be utilized. As a result, the present embodiment of the claimed invention reduces IPA waste.

Referring again to FIG. 4B, offset rows 52 and 54 prevent contaminated condensate from dripping off of the semiconductor wafers and back into the reservoir of very pure IPA. Specifically, any contaminated condensate which falls from semiconductor wafers 56 of FIG. 3 will either be collected on semi-circular catch trays 74, or fall through the openings between semi-circular catch trays 74. However, by arranging rows 52 and 54 in an offset manner as set forth in the present embodiment, any condensate which falls through the openings between semi-circular catch trays 74 will be collected by semi-circular catch trays 72 of row 52. In the present embodiment, semi-circular catch trays 72 and 74 are positioned in a tilted configuration so that any contaminated condensate collected in semi-circular catch trays 72 or 74 will flow towards the collector tray 70 and be funneled into drain 58. Thus, the present invention does not significantly restrict the upward flow of vaporized IPA, and does not force the flow of vaporized IPA to the edges of IPA tank 50 of FIG. 3.

Figure 5:
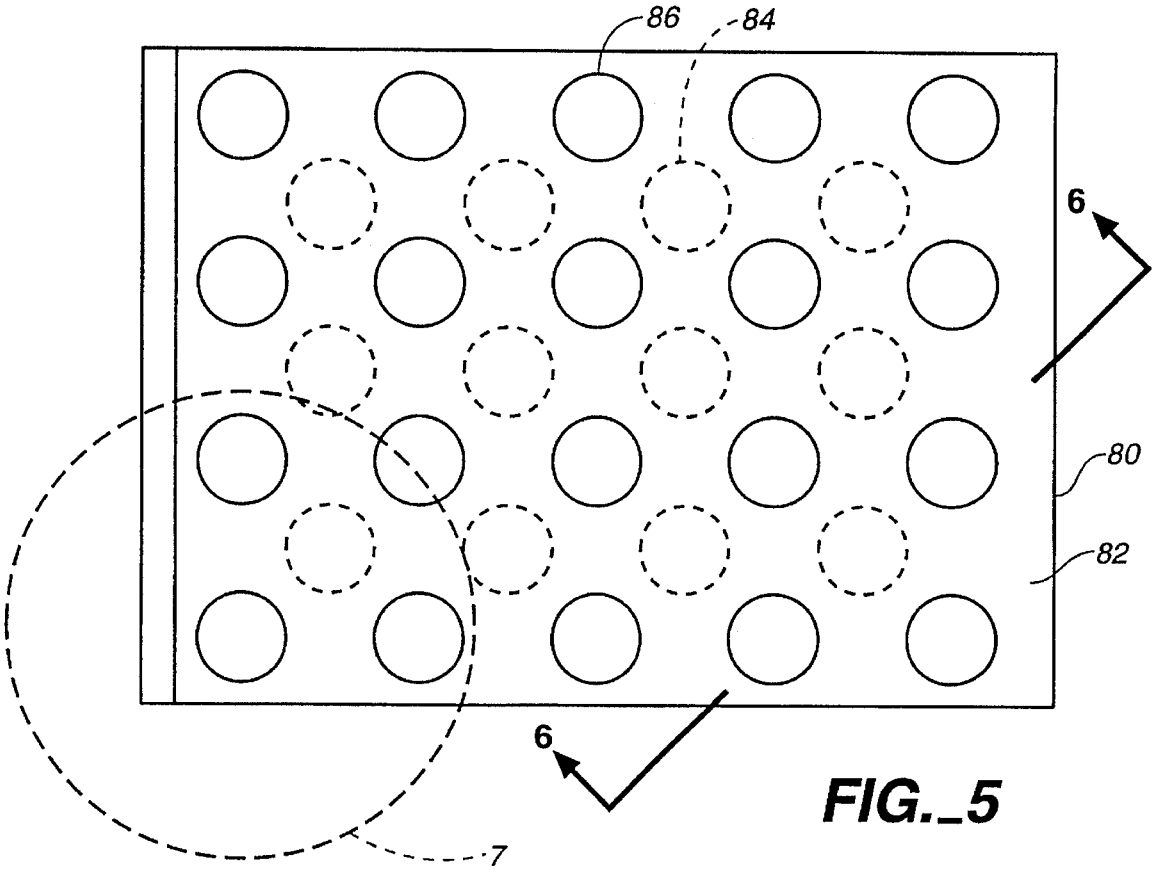
FIG. 5 is a top view of another embodiment of the inventions using two parallel plates having circular offset openings formed therein.
Figure 6:
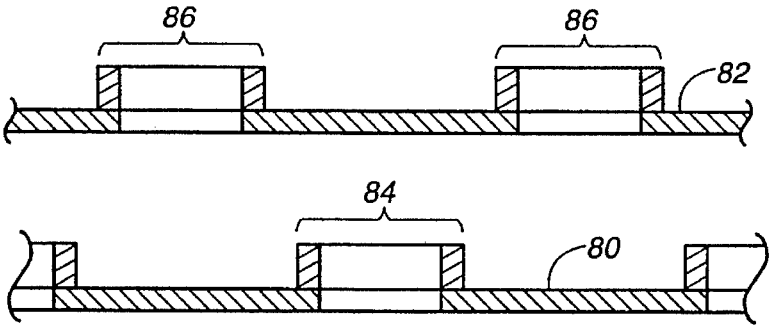
FIG. 6 is a section view of another embodiment of the two offset rows of FIG. 3.
Figure 7:
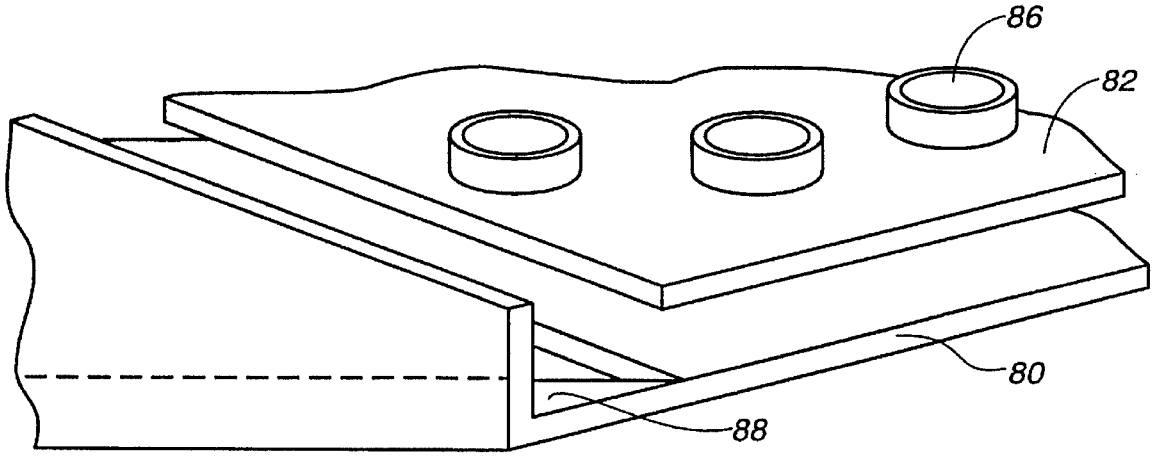
FIG. 7 is an enlarged sectional, perspective view of section 7 of FIG. 8.

With reference next to FIGS. 5, 6, and 7 plan, partially sectional, and enlarged partially sectional perspective views of another embodiment of the present invention are shown. As shown in the FIG. 5, instead of having two offset rows of coplanar parallel catch trays, the catch trays of the present embodiment are formed of two offset parallel plates 80 and 82 having openings 84 and 86, respectively, formed therethrough. In the present embodiment, vaporized IPA is able to rise from the bottom of tank 50 of FIG. 3, proceed through openings 84 present in plate 80, and then continue upward and proceed through openings 86 present in plate 82. Thus, in the present embodiment of the claimed invention, vaporized IPA is able to flow upwardly from the center of tank 50 of FIG. 3 without being forced to the outer edges of tank 50.

With reference again to FIGS. 5, 6, and 7, as in the previous embodiments, offset parallel plates 80 and 82 prevent contaminated condensate from dripping off of the semiconductor wafers and back into the reservoir of very pure IPA. Specifically, any contaminated condensate which falls from semiconductor wafers 56 of FIG. 3 will either be collected on parallel plate 82, or fall through openings 86 formed therethrough. However, by arranging plates 80 and 82 in an offset manner as set forth in the present embodiment, any condensate which falls through openings 84 and 86 will be collected on plate 80. In the present embodiment, parallel plates 80 and 82 are positioned in a tilted configuration so that any contaminated condensate collected on plates 80 or 82 will flow towards the collector drain 88 and will be funneled into a drain. Additionally, openings 84 and 86 are surrounded by circular weirs to prevent any contaminated condensate collected on the top surface of plates 80 and 82 from passing through openings 84 and 86.

Referring again to FIGS. 5, 6, and 7, by arranging plates 80 and 82 in an offset manner, any uncontaminated IPA vapor which condenses onto the bottom surface of plate 82 will drip off of plate 82 and will pass through openings 84 of plate 80 and will fall back into IPA reservoir 60 of FIG. 3. Likewise, any uncontaminated IPA vapor which condenses onto the bottom surface of plate 80 will fall back into IPA reservoir 60 of FIG. 3. Thus, the present embodiment, unlike the prior art, returns uncontaminated condensate to the IPA reservoir so that it may be utilized. As a result, the present embodiment of the claimed invention reduces IPA waste, and does not force the flow of vaporized IPA to the edges of IPA tank 50 of FIG. 3.

Figure 10:
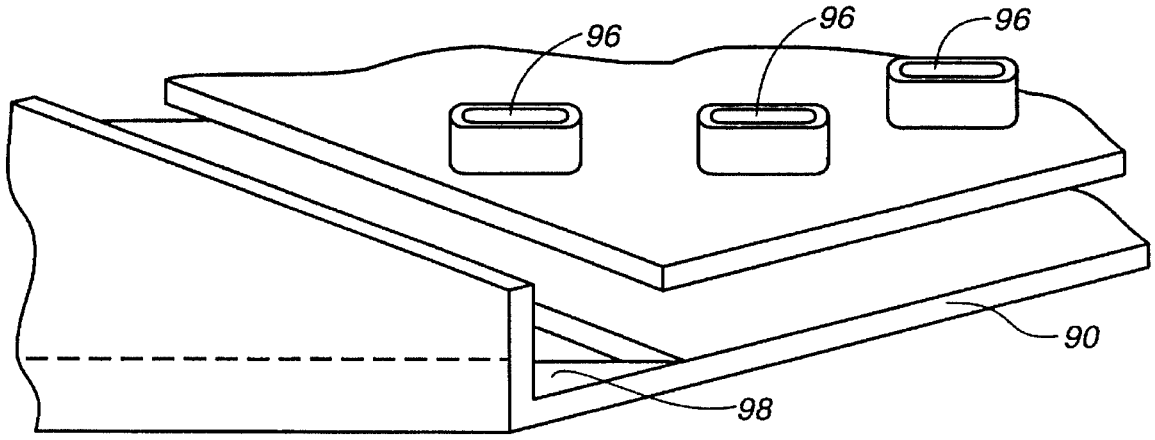
FIG. 10 is an enlarged section, perspective view of section 10 of FIG. 8.
Figure 8:
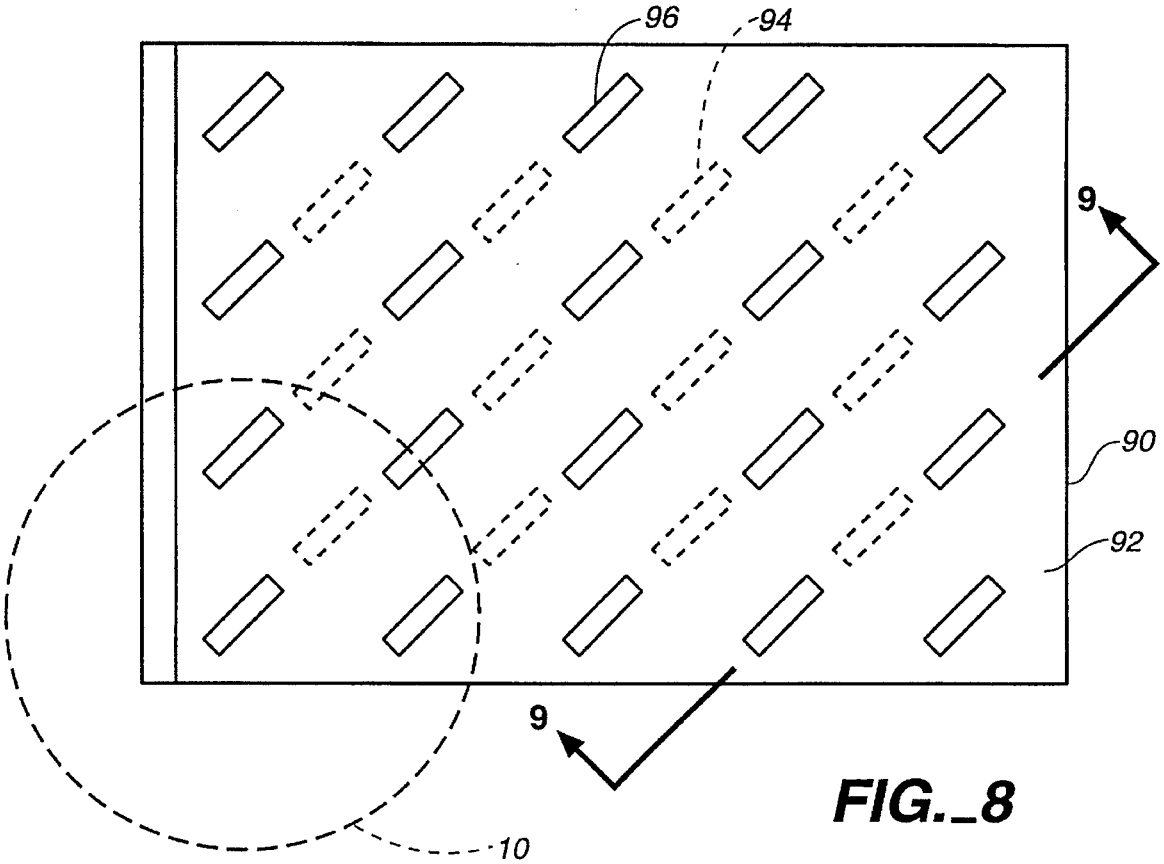
FIG. 8 is a top view of still another embodiment of the invention using two parallel plates having slit-shaped offset opening formed therein.
Figure 9:
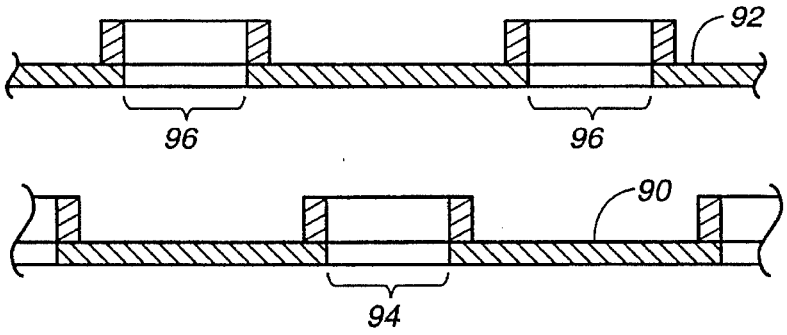
FIG. 9 is a partial cross-sectional view taken along sections line 9—9 of FIG. 8.

With reference again to FIG. 6, although collector drain is located at one end of plates 80 an 82, in the present embodiment, the claimed invention is also well suited to other configurations of plates 80 and 82 which would allow collector 88 to be located elsewhere in tank 50 of FIG. 3, including but not limited to, for example, the center of the tank. Furthermore, although openings 84 and 86 are circular in the present embodiment, the claimed invention is also well suited to numerous variations in the shape of openings 84 and 86, including but not limited to, for example, slit-shaped openings as shown in FIGS. 8, 9 and 10. With reference to FIGS. 8, 9, and 10, plates 90 and 92 are similar to plates 80 and 82 of FIG. 5. The openings 94, 96 are shown as elongated slits.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

I claim:

1. An IPA tank vapor/liquid phase separator comprising:

a first row of a plurality of first coplanar parallel catch trays disposed above the top surface of IPA in an IPA tank, each of said plurality of said first catch trays spaced apart from each other with a first opening located between adjacent first catch trays, a second row of a plurality of second coplanar parallel catch trays disposed between said top surface of said IPA in said IPA tank and said first row of said plurality of said first catch trays, each of said plurality of said second catch trays spaced apart from each other with a second opening located between adjacent second catch trays, said second row of said plurality of said second catch trays disposed such that respective second catch trays are located directly between respective first openings and said top surface of said IPA in said IPA tank, and such that respective second openings are located directly between respective first catch trays and said top surface of said IPA in said IPA tank, a first end of said first row of said plurality of said first catch trays and a first end of said second row of said plurality of said second catch trays coupled to a drain in said IPA tank; and wherein each of said plurality of said first catch trays are V-shaped and are disposed in an upright position with each of said plurality of first V-shaped catch trays opening away from said top surface of said IPA in said IPA tank.

2. The IPA tank vapor/liquid phase separator of claim 1 wherein each of said plurality of said second catch trays are V-shaped and are disposed in an upright position with each of said plurality of second V-shaped catch trays opening away from said top surface of said IPA in said IPA tank.

3. The IPA tank vapor/liquid phase separator of claim 1 wherein a second end of said first row of said plurality of said first catch trays is elevated above said first end of said first row of said plurality of said first catch trays such that fluid collected on each of said plurality of said first catch trays flows towards said drain in said IPA tank.

4. The IPA tank vapor/liquid phase separator of claim 1 wherein a second end of said second row of said plurality of said second catch trays is elevated above said first end of said second row of said plurality of said second catch trays such that fluid collected on each of said plurality of said second catch trays flows towards said drain in said IPA tank.

5. An IPA tank vapor/liquid phase separator comprising:

a first plate, having a top and a bottom surface and a plurality of first openings formed therethrough, disposed above the top surface of IPA in an IPA tank with said bottom surface of said first plate facing said top surface of said IPA in said IPA tank, each of said plurality of said first openings peripherally surrounded by a raised area located on said top surface of said first plate, a second plate, having a top and a bottom surface and a plurality of second openings formed therethrough, disposed between said bottom surface of said first plate and said top surface of said IPA in said IPA tank with said bottom surface of said second plate facing said top surface of said IPA in said IPA tank, each of said plurality of said second openings peripherally surrounded by a raised area located on said top surface of said second plate, said second plate disposed such that none of said second openings are located directly between said first openings of said first plate and said top surface of said IPA in said IPA tank, a first edge of said first plate and a first edge of said second plate coupled to a drain in said IPA tank.

6. The IPA tank vapor/liquid phase separator of claim 5 wherein said first openings in said first plate are circular shaped.

7. The IPA tank vapor/liquid phase separator of claim 5 wherein said second openings in said second plate are circular shaped.

8. The IPA tank vapor/liquid phase separator of claim 5 wherein said first openings in said first plate are slits.

9. The IPA tank vapor/liquid phase separator of claim 5 wherein said second openings in said second plate are slits.

10. The IPA tank vapor/liquid phase separator of claim 5 wherein a second edge of said first plate is elevated above said first edge of said first plate such that fluid collected on said first plate flows towards said drain in said IPA tank.

11. The IPA tank vapor/liquid phase separator of claim 5 wherein a second edge of said second plate is elevated above said first edge of said second plate such that fluid collected on said second plate flows towards said drain in said IPA tank.

12. An IPA tank vapor/liquid phase separator comprising:

a first row of a plurality of first coplanar parallel catch trays disposed above the top surface of IPA in an IPA tank, each of said plurality of said first catch trays spaced apart from each other with a first opening located between adjacent first catch trays, a second row of a plurality of second coplanar parallel catch trays disposed between said top surface of said IPA in said IPA tank and said first row of said plurality of said first catch trays, each of said plurality of said second catch trays spaced apart from each other with a second opening located between adjacent second catch trays, said second row of said plurality of said second catch trays disposed such that respective second catch trays are located directly between respective first openings and said top surface of said IPA in said IPA tank, and such that respective second openings are located directly between respective first catch trays and said top surface of said IPA in said IPA tank, a first end of said first row of said plurality of said first catch trays and a first end of said second row of said plurality of said second catch trays coupled to a drain in said IPA tank; and wherein each of said plurality of said first catch trays have a semi-circular shape and are disposed in an upright position with each of said plurality of first semi-circular shaped catch trays opening away from said top surface of said IPA in said IPA tank.

13. The IPA tank vapor/liquid phase separator of claim 12 wherein each of said plurality of said second catch trays have a semi-circular shape and are disposed in an upright position with each of said plurality of second semi-circular shaped catch trays opening away from said top surface of said IPA in said IPA tank.

14. The IPA tank vapor/liquid phase separator of claim 12 wherein a second end of said first row of said plurality of said first catch trays is elevated above said first end of said first row of said plurality of said first catch trays such that fluid collected on each of said plurality of said first catch trays flows towards said drain in said IPA tank.

15. The IPA tank vapor/liquid phase separator of claim 12 wherein a second end of said second row of said plurality of said second catch trays is elevated above said first end of said second row of said plurality of said second catch trays such that fluid collected on each of said plurality of said second catch trays flows towards said drain in said IPA tank.

* * * * *